US006715467B2

(12) United States Patent
Nelson et al.

(10) Patent No.: US 6,715,467 B2
(45) Date of Patent: Apr. 6, 2004

(54) METHOD AND APPARATUS FOR ENGINE BRAKING

(75) Inventors: Bryan E. Nelson, Lacon, IL (US); Joshua C. Ruedin, Peoria, IL (US); Gregory J. Speckhart, Peoria, IL (US); Jeffrey M Thate, Peoria, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/224,868

(22) Filed: Aug. 21, 2002

(65) Prior Publication Data

US 2004/0035387 A1 Feb. 26, 2004

(51) Int. Cl.[7] ..... F02D 13/04
(52) U.S. Cl. ..... 123/322; 123/321
(58) Field of Search ..... 123/321, 322

(56) References Cited

U.S. PATENT DOCUMENTS 5,357,912 A 10/1994 Barnes et al.
5,483,927 A 1/1996 Letang et al.
5,609,134 A 3/1997 Schmidt et al.
5,636,611 A * 6/1997 Frankle et al. ..... 123/322
5,657,838 A 8/1997 Vogelsang et al.
5,816,665 A 10/1998 Burnett et al.
5,842,376 A 12/1998 Dresden, III et al.
6,205,975 B1 3/2001 Ruedin et al.
6,216,670 B1 4/2001 Anderson et al.
6,283,090 B1 9/2001 Harmon
6,293,238 B1 9/2001 Harmon
6,298,675 B1 10/2001 Dage et al.

* cited by examiner

*Primary Examiner*—Erick Solis
(74) *Attorney, Agent, or Firm*—R. C. Wilbur; Stephen L. Noe

(57) ABSTRACT

An engine braking system includes a pump associated with a source of fluid, the pump supplying pressurized fluid to fuel injectors associated with the engine. An electronic controller is associated with the engine and determines a desired engine braking level as a function of various engine operating conditions and operator inputs. The engine controller produces a pump signal as a function of the desired engine braking level.

19 Claims, 3 Drawing Sheets

METHOD AND APPARATUS FOR ENGINE BRAKING

TECHNICAL FIELD

The present invention is related generally to the field of internal combustion engines, and more particularly, to the field of engine braking in connection with such internal combustion engines.

BACKGROUND

On highway trucks often carry heavy loads that can total as much as eighty thousand pounds. These trucks have a significant amount of momentum while travelling down the road, especially when travelling at highway speeds, and often require large brakes associated with the wheels (generally referred to as the service brakes) to slow the truck. The service brakes generally rely on friction to slow the wheels and therefore must convert momentum energy of the truck into heat. Since the service brakes are subject to a significant amount of heat and wear in connection with slowing the vehicle, they can represent a significant operating expense if used inefficiently.

Truck manufacturers and operators have recognized that there is a need to be able to generate braking force through devices other than the service brakes. By using other devices the truck operator can extend the life of the service brakes and therefore decrease the operating cost of the truck. Engine compression brakes are one such way to achieve braking force. In general, engine compression brakes create braking force by allowing air that has entered the engine cylinders during the intake stroke to be compressed during the compression stroke, thereby consuming energy. Then, prior to the expansion stroke of the piston (which would return some of the energy stored in the compressed air back to the piston), the exhaust valve is opened to simply exhaust the compressed air. In this manner the engine acts as a compressor, relieving the compressed air out the exhaust, thereby consuming energy from the wheels through the drivetrain to create a braking force. Although, engine compression braking through the selective use of the cylinder valves works well, it would also be desirable to be able to controllably apply additional engine braking force.

The present invention is directed toward overcoming these and other drawbacks associated with prior art systems.

SUMMARY OF THE INVENTION

In one aspect of the present invention, an engine braking system is disclosed for use on an internal combustion engine, having fuel injectors associated with said engine. Also associated with the engine is a pump that provides pressurized fluid to the fuel injectors. An electronic controller is associated with the engine and determines a desired level of engine braking in response to determined engine operating conditions and produces a pump signal as a function of the desired level of engine braking signal.

These and other aspects and advantages of the invention will become apparent upon reviewing the specification in connection with the drawings and appended claims.

DETAILED DESCRIPTION

Figure 1:
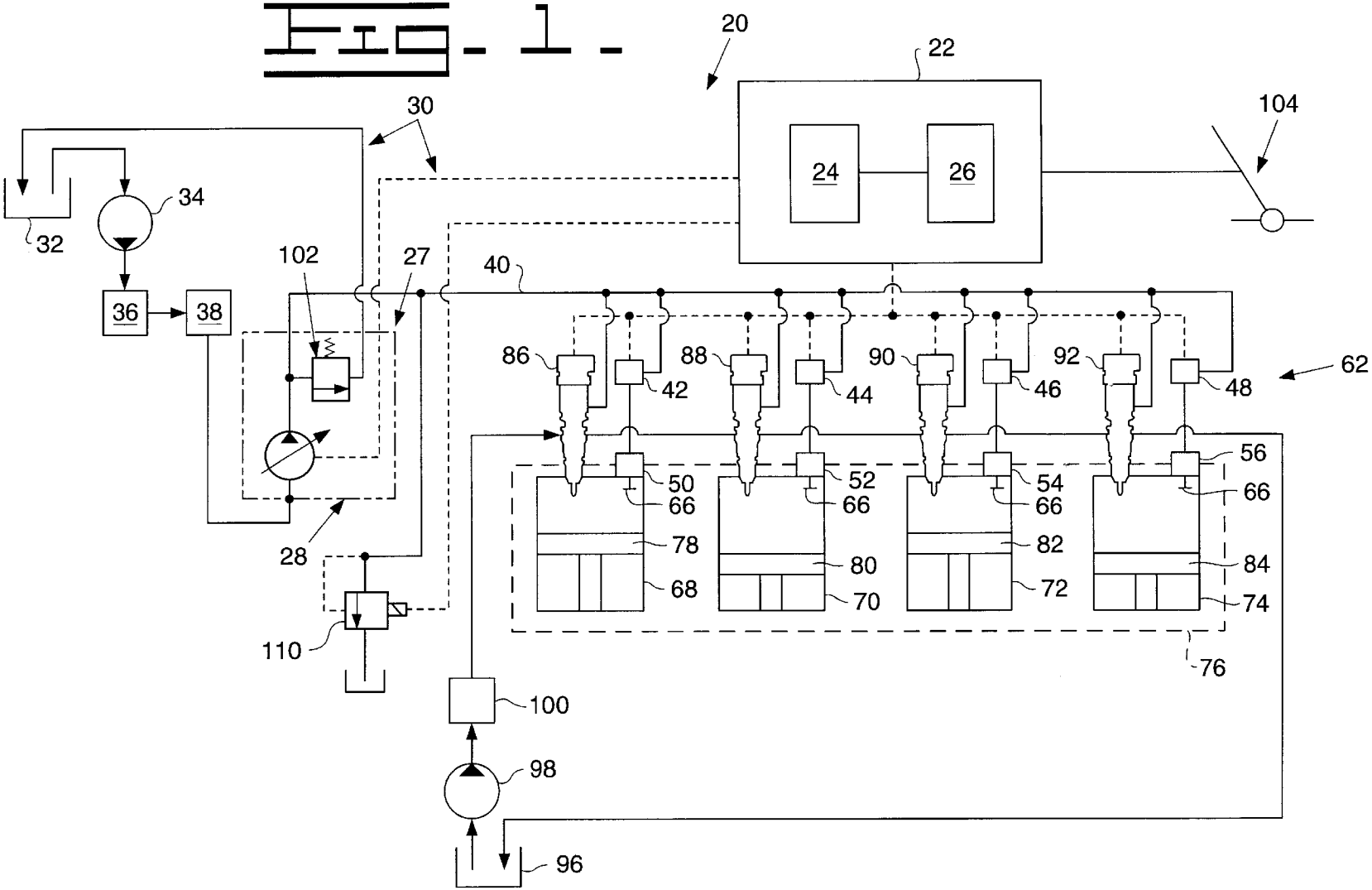
FIG. 1 is a block diagram of an embodiment of an engine and engine braking system.

The present invention is explained herein with reference to a preferred embodiment of the invention as shown in the drawings and described herein. Those skilled in the art will recognize that the present invention is not limited to the single embodiment shown in the drawings and described herein, but also includes other alternative embodiments and configurations that fall within the scope of the appended claims. Throughout the drawings and specification like element numbers shall be used to refer to like components of the preferred embodiment.

Referring first to FIG. 1, a system level block diagram of a preferred embodiment of the engine braking system 20 is shown. The engine braking system 20 preferably includes an electronic controller 22. Those skilled in the art will recognized that the electronic controller 22 includes a microcontroller or processor 24, a memory device or devices 26 for storing software control and data values, input/output circuitry (not shown) to permit the controller to issue control signals to actuators outside the electronic controller and to receive sensor and other signals from outside the electronic controller, and other known features of an electronic controller 22.

Preferably, the engine 76 includes a device for producing high pressure fluid 27, which in a preferred embodiment may include a high pressure pump 28, which is connected with the electronic controller 22 and receives signals from the electronic controller that affect the output of the pump 28. In a preferred embodiment, the high pressure pump 28 is a variable displacement pump which includes a relief valve 102 connected between a high pressure rail 40 and a hydraulic reservoir 32. In a preferred embodiment, the relief valve 102 relieves excess flow produced by the pump 28 that is not consumed by the fuel injectors, engine valves, engine brake or other engine components or accessories that use the pressurized hydraulic fluid. Although a preferred embodiment includes a high pressure pump 28 with a relief valve 102, other embodiments may include a separate relief valve 110, which may be electronically controlled and may be used alone or in combination with the pump relief valve 102. Although a preferred embodiment uses a variable displacement pump, other embodiments may use a fixed displacement pump or other known pumps without deviating from the scope of the present invention.

In a preferred embodiment, the high pressure pump 28 is connected with a hydraulic reservoir 32, through a low pressure pump 34, a heat exchanger 36, and a fluid filter 38. The low pressure pump draws hydraulic fluid from the reservoir 32 and outputs the hydraulic fluid through the heat exchanger 36 and the fluid filter 38 to the high pressure pump 28. The high pressure pump outputs the fluid at a higher pressure into the high pressure rail 40, which is simply a connection between the pump and fuel injectors 86, 88, 90 and 92. In a preferred embodiment, the pressure of the fluid in the rail 40 supplied to the fuel injectors is determined, at least in part, by a rail pressure control signal provided to the pump 28 by the electronic controller 22. The high pressure rail 40 is connected with each of the fuel injectors 86, 88, 90 and 92 and the high pressure fluid in the rail 40 provides actuating force to the fuel injectors 86, 88, 90 and 92. In a preferred embodiment, the hydraulic fluid includes engine oil and the reservoir 32 is preferably the engine oil pan. However, in other embodiments the high pressure fluid could include high pressure diesel fuel or any other relatively incompressible fluid that can be pressurized sufficiently to be used for the actuating force for the fuel injectors 86, 88, 90, and 92. The fuel injectors 86, 88, 90, 92 are electrically connected with the electronic controller 22, which outputs injection signals that, in combination with other factors such as rail pressure, determine the timing, quantity, rate shaping and other variables of the fuel injection event.

The engine braking system 20 preferably includes compression braking means for actuating at least the exhaust valves 66 for at least some of the engine cylinders 68, 70, 72, 74. There are engine compression braking systems that are commercially available as either original equipment, installed on the assembly line, or as an aftermarket add-on. Jacobs Manufacturing offers several different engine compression braking configurations that may be used in connection with some embodiments of the present invention. In a preferred embodiment, however, the engine compression braking system includes actuators 62 that are connected with and controlled by the electronic controller 22. The actuators preferably include a solenoid controlled valve 42, 44, 46, 48 that is connected with a fluid actuator, which in a preferred embodiment are hydraulic actuators 50, 52, 54, 56 connected with a respective exhaust valve 66 of a cylinder 68, 70, 72 and 74 of the engine 76. As noted above with respect to the fuel injectors 86, 88, 90, 92, although a preferred embodiment uses hydraulic fluid to supply actuating force, in other embodiments of the present invention, other pressurized fluids could also be used in connection with the actuators without deviating from the scope of the present invention as defined by the appended claims.

Figure 2:
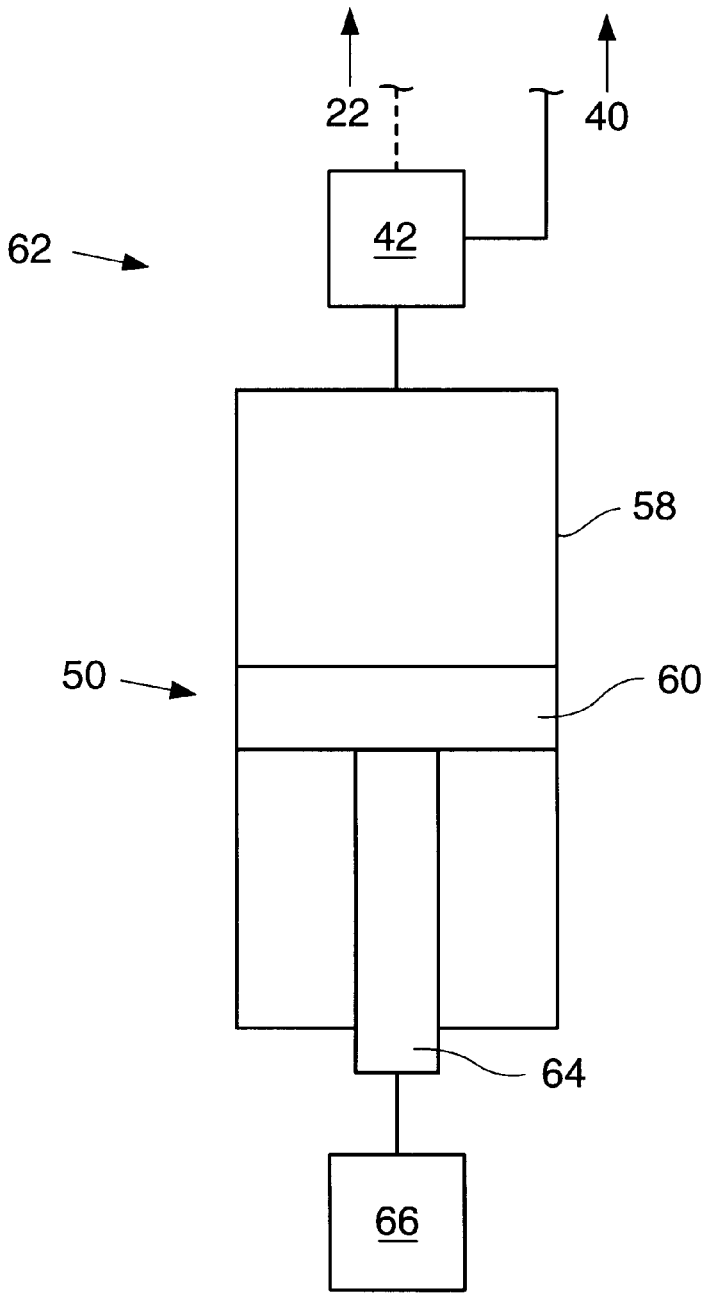
FIG. 2. shows an actuator associated with a cylinder of the engine in a preferred embodiment of the present invention.

Referring now to FIG. 2, a block diagram of an actuator 62 is shown. As shown in the drawing, a solenoid controlled valve 42 is connected with and controlled by signals produced by the electronic controller 22. The valve 42 is also connected with the source of high pressure fluid, shown in the drawing as the high pressure rail 40. When the electronic controller 22 issues an appropriate signal, the solenoid controlled valve 42 allows pressurized fluid to flow into a chamber 58. A piston 60 is preferably disposed within the chamber 58 and moves within the chamber 58 as a function of the fluid allowed to enter the chamber 58 by the solenoid controlled valve 42. As shown in the drawing, the piston 60 is preferably connected with a rod 64 or other mechanism for transmitting the piston 60 motion to an exterior of the actuator 50. The rod 64 is associated with an exhaust valve 66 mechanism in such a way that appropriate motion of the rod causes motion of an exhaust valve 66. In this manner, when the electronic controller 22 issues an appropriate signal to the actuator 50 the exhaust valve 66 may be opened or closed. Thus, the controller 22 in combination with the actuators 50 and exhaust valves 66, and associated components, can be used to create engine compression braking.

As shown in FIG. 1, the engine exhaust valves 66 may be associated with one of a plurality of engine cylinders 68, 70, 72 and 74 of the engine 76. An engine piston 78, 80, 82, 84 may be associated with each of the engine cylinders 68, 70, 72 and 74. While only four engine cylinders are shown in the drawing, those skilled in the art will recognize that this is, for illustration purposes only and is not intended to limit the present invention to application on an engine with four cylinders. To the contrary, the engine braking system described herein may be applied to engines with six, eight or other numbers of engine cylinders without deviating from the scope of the present invention as defined by the appended claims. Further, although the drawing of FIG. 1, illustrates certain features associated with the engine 76, those skilled in the art will recognize that other components are included with such engine 76, but are omitted from the drawing for clarity. For example; although the drawing shows one exhaust valve 66 associated with each of the engine cylinders 68, 70, 72 and 74, those skilled in the art will recognize that the engine could include additional exhaust valves, and also includes at least one intake valve (not shown). Likewise, the number of actuators 50, may also be increased.

As is known to those skilled in the art, the electronic controller 22 preferably produces fuel injection signals, which are delivered to the fuel injectors 86, 88, 90, and 92. The fuel injection signals determine the timing and amount of fuel to be injected into the individual engine cylinders 68, 70, 72 and 74. Various strategies exist for calculating the timing and duration of those injections. However, those strategies are beyond the scope of the present invention and therefore are not discussed herein. Fuel is delivered to the fuel injectors 86, 88, 90, and 92 through a fuel line 106 which is connected with a fuel reservoir or fuel tank 96 through a fuel pump 98 and a fuel filter 100. Fuel that is not injected into an engine cylinder is returned to the reservoir through a return line 108.

As will be apparent to those skilled in the art, the high pressure rail 40 may have a high pressure relief valve (not shown) associated with the rail to limit the pressure in the rail. As shown in FIG. 1, the high pressure relief valve 102 is shown associated with the high pressure pump 28, although it could be placed elsewhere within the system and perform the same function.

The electronic controller 22 may be programmed in connection with the algorithm shown in FIG. 3, which as described in the following paragraphs performs engine braking. The electronic controller 22, preferably receives operator inputs and inputs from various sensors on the engine 76 and on the truck to determine that engine braking is appropriate. The electronic controller then preferably generates an engine braking signal. For example, one operator input may be a throttle pedal position 104, which will indicate to the electronic controller 22 whether the operator is demanding power from the engine. In the event that the operator is pressing the throttle pedal and demanding power, then the electronic controller 22 will determine that no engine braking is required and will not generate the engine braking signal. In some embodiments, there are also switches or other operator interface devices such as touch pads or the like, which will allow the operator to enable, or disable engine braking. In a preferred embodiment, the electronic controller 22 will use those inputs to determine whether to generate the engine braking signal. Algorithms used to determine when engine braking is required are known in the art and are therefore not discussed further herein. However, the algorithm discussed below with reference to FIG. 3, creates additional engine braking once the controller determines that braking is necessary and therefore discusses some of the novel aspects of engine braking associated with the present invention.

INDUSTRIAL APPLICABILITY

Figure 3:
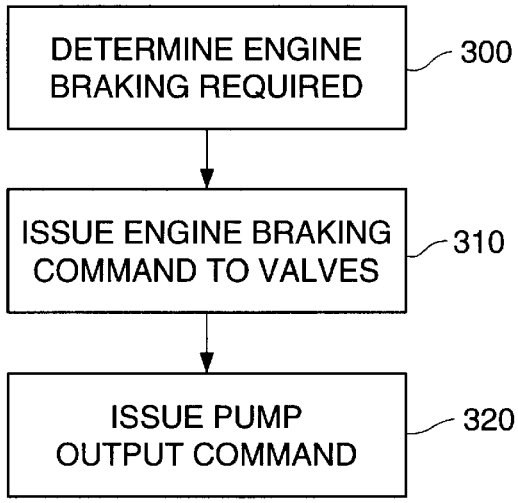
FIG. 3 is a flow chart of a preferred embodiment of an algorithm incorporated in software control for performing engine braking.

Referring now to FIG. 3, a flowchart of an embodiment of an algorithm associated with software control for a preferred embodiment of the invention is shown. In block 300, the electronic controller 22 determines that engine braking is required. Program control then passes to block 310.

In block 310, the electronic controller 22 issues a braking command to the engine compression brake associated with the engine exhaust valves 66. The braking command may take the form of a single signal to a bolt on, or aftermarket, compression brake, or the signal may be several signals to the individual actuators 62 at appropriate times and durations to effectuate the compression braking. Program control then passes to block 320.

Figure 4:
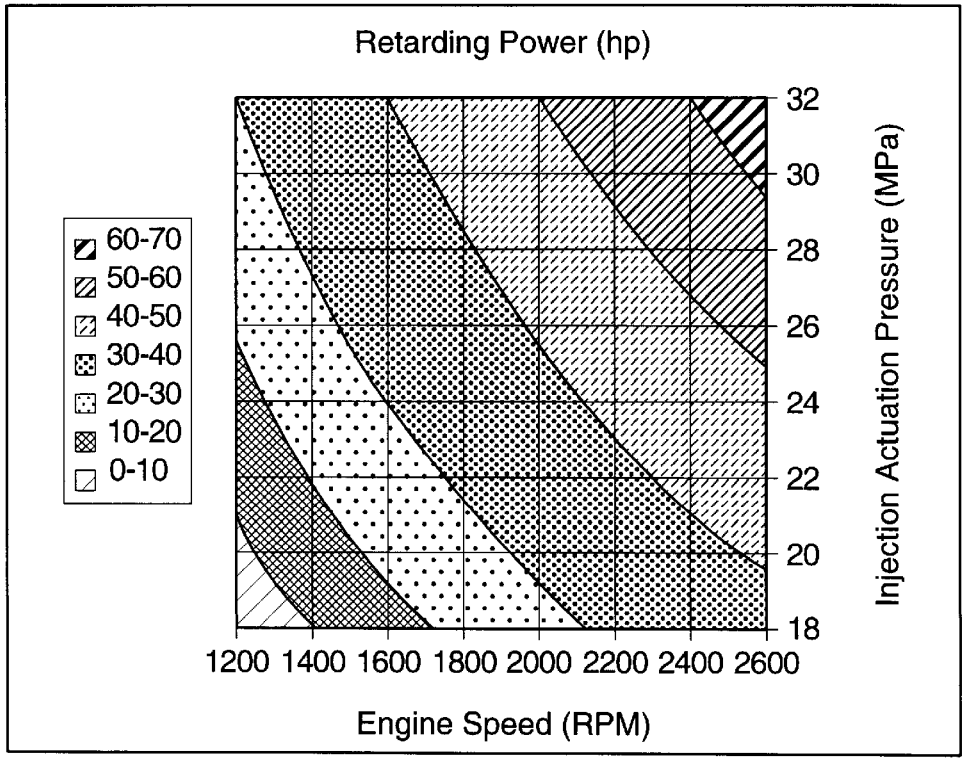
FIG. 4 shows a graph of braking horsepower that can be generated using an embodiment of the present invention.

In block 320, the electronic controller 22 issues a pump output command to the high pressure pump 28 that preferably causes the pump to go to maximum displacement. The power required by the pump is a function of flow rate and output pressure. Since the flow rate is a function of the commanded pump displacement and the pump speed, and since the pump speed is a function of engine speed, flow rate can be calculated from the commanded pump displacement and the engine speed. Excess flow not required by the system to actuate compression brakes, valves or other engine systems or accessories is preferably relieved by a relief valve 102 which is internal to the high pressure pump 28. In an alternate embodiment, a high pressure relief valve 110 may be connected between the high pressure rail 40 and the reservoir 32 and can be used to control excess flow. The output pressure of the pump is determined, in part, by sensing the rail pressure and the pump output command. For example, in some embodiments the rail pressure is a closed loop control and the pressure can be varied by the electronic controller 22 depending on engine operating conditions. In one set of circumstances, the electronic controller 22 may control rail pressure to about 30 MPa. Referring to FIG. 4, the power dissipated by the pump, for one pump configuration, is shown for various rail pressures, and for various engine speeds. FIG. 4 generally illustrates the braking effect of an embodiment of the present invention, and although one embodiment of the present invention may achieve the power dissipation levels shown in FIG. 4, other engine and pump configurations may result in a greater or lesser amount of power being dissipated through the engine braking process.

What is claimed is:

1. An engine braking system comprising:

an internal combustion engine;

fuel injectors associated with said engine;

a pressurized source of fluid associated with said fuel injectors, said pressurized fluid providing power to actuate a fuel injector;

a pump associated with said fluid, said pump being connected with said engine and pressurizing said source of fluid;

an electronic controller associated with said engine, said controller determining a desired engine braking level in response to determined engine operating conditions and producing a pump signal as a function of said desired engine braking level.

2. The engine braking system of claim 1, wherein:

said pump is a variable displacement pump; and said pump signal includes a command to run the pump at fill displacement.

3. The engine braking system of claim 1, including:

a compression brake associated with exhaust valves of said engine;

wherein said compression brake is connected with said source of pressurized fluid; and wherein said electronic controller activates said compression brake as a function of said desired engine braking level thereby causing an exhaust valve to open while an engine cylinder has compressed air therein.

4. The engine braking system of claim 1, wherein said pump signal includes a command to increase the pressure of said source of pressurized fluid.

5. The engine braking system of claim 2, wherein said pump signal includes a command to increase the pressure of said source of pressurized fluid.

6. The engine braking system of claim 4, wherein said fluid comprises engine oil.

7. The engine braking system of claim 4, wherein said fluid comprises fuel.

8. The engine braking system of claim 2, wherein said electronic controller determines said desired engine braking level as a function of operator inputs and at least one sensed engine operating parameter.

9. The engine braking system of claim 2, wherein said at least one sensed engine operating parameter includes an engine speed.

10. The engine braking system of claim 1, including:

an electronically controlled fluid powered actuator associated with at least one exhaust valve of said engine and connected with said source of pressurized fluid and said electronic controller;

wherein said electronically controlled fluid powered actuator is responsive to said engine braking signal to controllably open and close said exhaust valve.

11. An engine braking system associated with a compression ignition engine, comprising:

at least one an electronically controlled fluid powered actuator associated with an exhaust valve of said engine;

a source of pressurized fluid connected with said actuator;

a pump associated with said source of pressurized fluid, an output flow of said pump controllable;

an electronic controller connected with said actuator, said pump, an operator input and an engine parameter sensor, wherein said engine controller produces a desired engine braking level signal as a finction of said operator input and said engine parameter sensor and produces a pump output signal as a function of said braking level signal.

12. The engine braking system according to claim 11, including:

at least one electronically controlled fluid actuated fuel injection device associated with a cylinder of said engine;

wherein said electronic controller is connected with said fuel injection device and produces a fuel injection signal to control fuel injected by said fuel injection device; and wherein said fuel injection device is connected with said source of pressurized fluid.

13. The engine braking system according to claim 11, wherein said pump includes a variable displacement pump.

14. The engine braking system according to claim 13, wherein flow output from said pump is a function of said pump output signal.

15. The engine braking system according to claim 14, wherein said pump output signal corresponds to a maximum flow output in response to said braking signal.

16. The engine braking system according to claim 13, including:

a pressure sensor associated with said source of pressurized fluid, said pressure sensor producing a signal indicative of the pressure of said fluid; and said electronic controller receiving said pressure signal and producing said pump output signal as a function of said signal and a desired pressure.

17. The engine braking system according to claim 15, including:

a pressure sensor associated with said source of pressurized fluid, said pressure sensor producing a signal indicative of the pressure of said fluid; and said electronic controller receiving said pressure signal and producing said pump output signal as a function of said signal and a desired pressure.

18. The engine braking system according to claim 16, wherein said desired pressure is increased as a function of said braking signal.

19. A method of providing engine braking for an internal combustion engine, said engine having associated fuel injectors, a pressurized source of fluid associated with and providing power to actuate said fuel injectors, a pump connected with said engine for pressurizing said fluid, and an electronic controller associated with said engine, comprising the steps of:

determining a desired engine braking level in response to determined engine operating conditions, and producing a pump signal as a function of said desired engine braking level.

* * * * *